US005199773A

United States Patent [19]

Price, Jr. et al.

[11] Patent Number: 5,199,773

[45] Date of Patent: Apr. 6, 1993

[54] DESK TYPE WORK STATION

[75] Inventors: Macy J. Price, Jr., Louisville; Daniel C. Starkey, Englewood, both of Colo.

[73] Assignee: Engineered Data Products, Inc., Broomfield, Colo.

[21] Appl. No.: 630,521

[22] Filed: Dec. 20, 1990

[51] Int. Cl.[5] ..... A47B 81/06

[52] U.S. Cl. ..... 312/7.2; 312/194; 312/208.1

[58] Field of Search ..... 312/194, 7.2, 208, 21, 312/29, 310, 208.1

[56] References Cited

U.S. PATENT DOCUMENTS

| | | | |
|---|---|---|---|
| 414,983 | 11/1889 | Mighell et al. | 312/29 |
| 2,516,281 | 7/1950 | Wilson | 312/29 |
| 4,590,866 | 5/1986 | Schairbaum | 108/23 |
| 4,640,199 | 2/1987 | Zigman . | |
| 4,669,789 | 6/1987 | Pemberton | 312/194 |
| 4,766,423 | 8/1988 | Wolters et al. | 340/700 |

FOREIGN PATENT DOCUMENTS

| | | | |
|---|---|---|---|
| 0145410 | 6/1985 | European Pat. Off. . | |
| 0317062 | 11/1956 | Switzerland | 312/29 |
| 659370 | 1/1987 | Switzerland . | |
| 0208628 | 12/1923 | United Kingdom | 312/29 |

OTHER PUBLICATIONS

Micro Center Brochure.

*Primary Examiner*—Kenneth J. Dorner
*Assistant Examiner*—Gerald A. Anderson
*Attorney, Agent, or Firm*—Glenn L. Webb

[57] ABSTRACT

A desk type work station having a top panel portion having an opening covered by a movable cover and supported by a pair of laterally spaced apart pedestals is provided with structure so that a keyboard and a CRT monitor may be stored out of sight beneath the top panel portion and wherein movement of the keyboard to an operative position permits automatic upward and forward movement of the CRT monitor to move the movable cover and pass at least partially through the opening so that it can be viewed by an operator.

17 Claims, 4 Drawing Sheets

DESK TYPE WORK STATION

FIELD OF THE INVENTION

This invention relates generally to desk type work stations such as those used in connection with computer type keyboards and CRT monitors and more particularly to desk type work stations when the keyboard and CRT monitor can be moved between stored and operating positions.

BACKGROUND OF THE INVENTION

There are many types of desk type work stations which have structures for supporting and storing various components for a computer processing system. In many of these desk type work stations, the components, such as a CRT monitor, are supported on the top of the desk or on structures mounted on the top of the desk so that portions of the work surface on the top of the desk are not available for use when there is no need to use the CRT monitor. In U.S. Pat. No. 4,755,009, there is disclosed a solution to the foregoing problem wherein a transparent panel is provided in the top panel portion of the desk and a CRT monitor is mounted beneath the transparent panel to be viewed by an operator. While this apparatus functions very well, it is sometimes necessary that the CRT monitor be closer to the operator that what is possible in this patented apparatus.

BRIEF DESCRIPTION OF THE INVENTION

This invention provides a desk type work station that has structure so that a keyboard and a CRT monitor may be stored in an out of sight location and the CRT monitor may be automatically moved upwardly and forwardly to a viewable position when desired.

In a preferred embodiment of the invention, the desk type work station comprises a top panel portion having a generally flat top work surface and an opposite bottom surface. A pair of spaced apart pedestal means are provided for supporting the top panel portion to form an open space beneath the top panel portion and between the spaced apart pedestal means. An opening is formed in the top panel portion. A cover portion is pivotally mounted on the top panel portion and is supported in the closed position to cover the opening and has a generally flat top surface that lies in the same plane as the generally flat top work surface to form a part thereof. Slidable shelf means are mounted on the top panel portion to support a keyboard. Support means are provided for supporting a CRT monitor and are mounted for automatic upward and forward movement between a first position at which the CRT monitor is located beneath the bottom surface of the top panel portion and a second position at which at least a portion of the CRT monitor extends through the opening so that at least the screen of the CRT monitor is visible to an operator. The CRT monitor support means are retained in position by the slidable shelf means which, in a closed position, are also located beneath the surface of the top panel portion. When the slidable shelf means are moved to an opened position, a force is automatically applied on the CRT monitor support means to move them from the first position to the second position. The mounting means for the CRT monitor support means comprise two spaced apart supports mounted at fixed locations. First and second guide means are mounted on each of the fixedly mounted supports. At least four guide followers are mounted on the CRT monitor support means for cooperating with the first and second guide means to guide the movement of the CRT monitor support means. In one preferred embodiment, each of the first guide track means have a first linear portion extending generally in a horizontal plane and a second linear portion extending upwardly therefrom and inclined relative thereto and each of the second guide means comprises a linear portion extending in a direction inclined to the horizontal at an angle that differs from that of the second linear portion. In another preferred embodiment, each of the first guide track means extends in a linear direction that is inclined to the horizontal and the second guide means extend in a linear direction that is inclined to the horizontal at an angle that differs from that of the first guide means. In a further preferred embodiment, each of the first guide means have a first linear portion that is inclined slightly from the horizontal and a second linear portion extending upwardly therefrom and inclined relative thereto, and each of the second guide means comprise a linear portion extending in a direction inclined to the horizontal at an angle that differs from the second linear portion.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
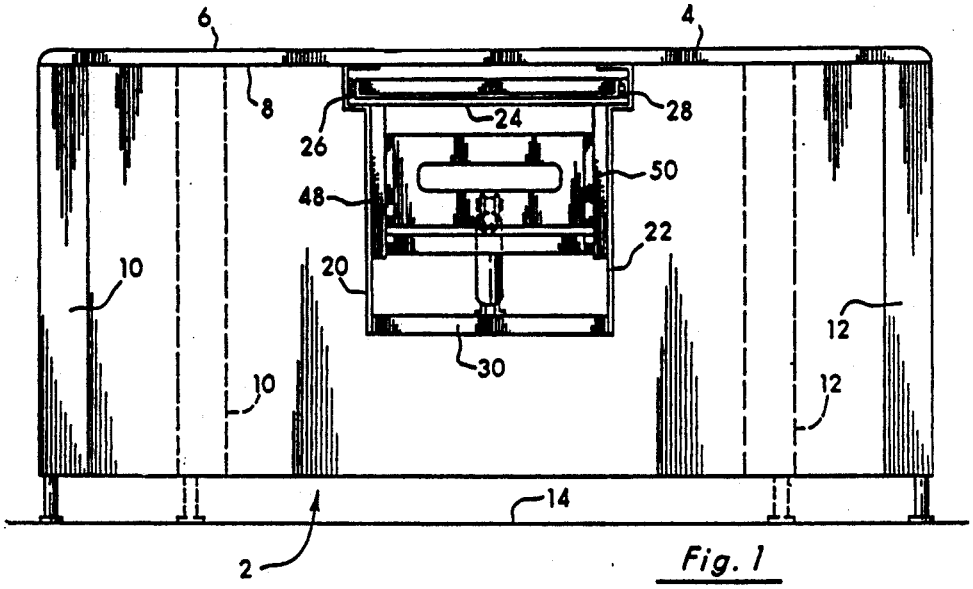
FIG. 1 is a front elevational view of a desk type work station of this invention.

In FIG. 1, there is illustrated a desk type work station 2 of this invention comprising a top panel portion 4 having a generally flat top work surface 6 and a bottom surface 8. The top panel portion 4 is supported on spaced apart pedestal means 10 and 12 which are in contact with a floor 14. As illustrated by the dashed lines in FIG. 1, the spaced apart pedestal means 10 and 12 could be at other locations.

Figure 3:
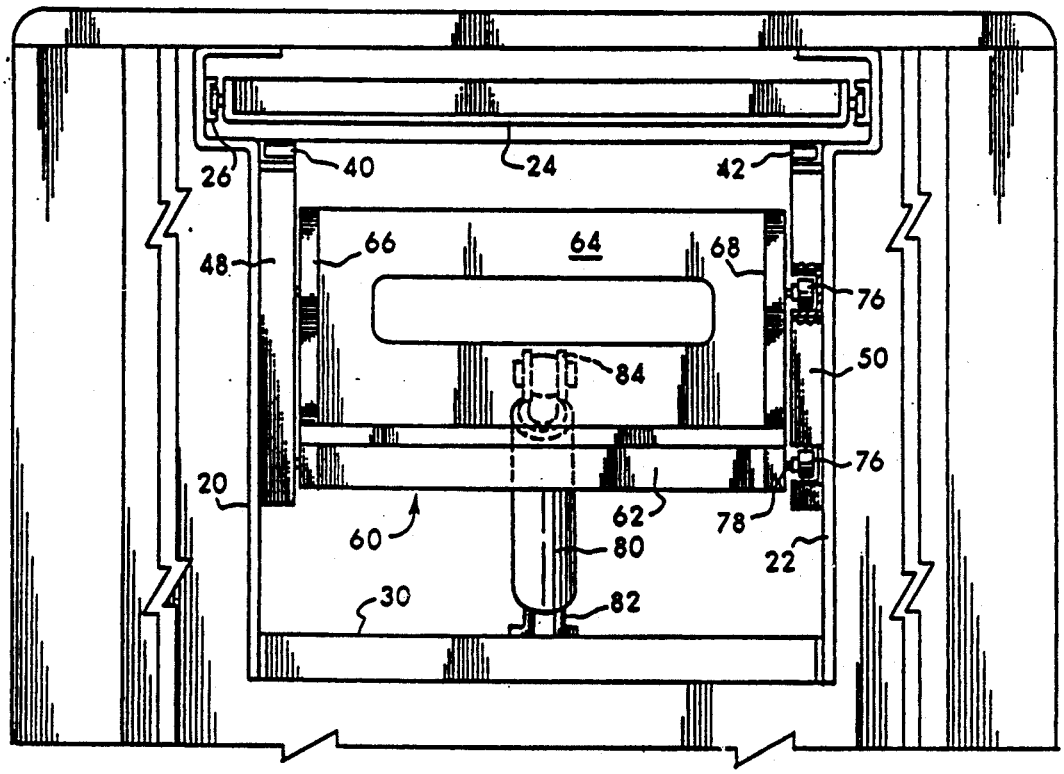
FIG. 3 is an enlarged view of a portion of FIG. 1.
Figure 4:
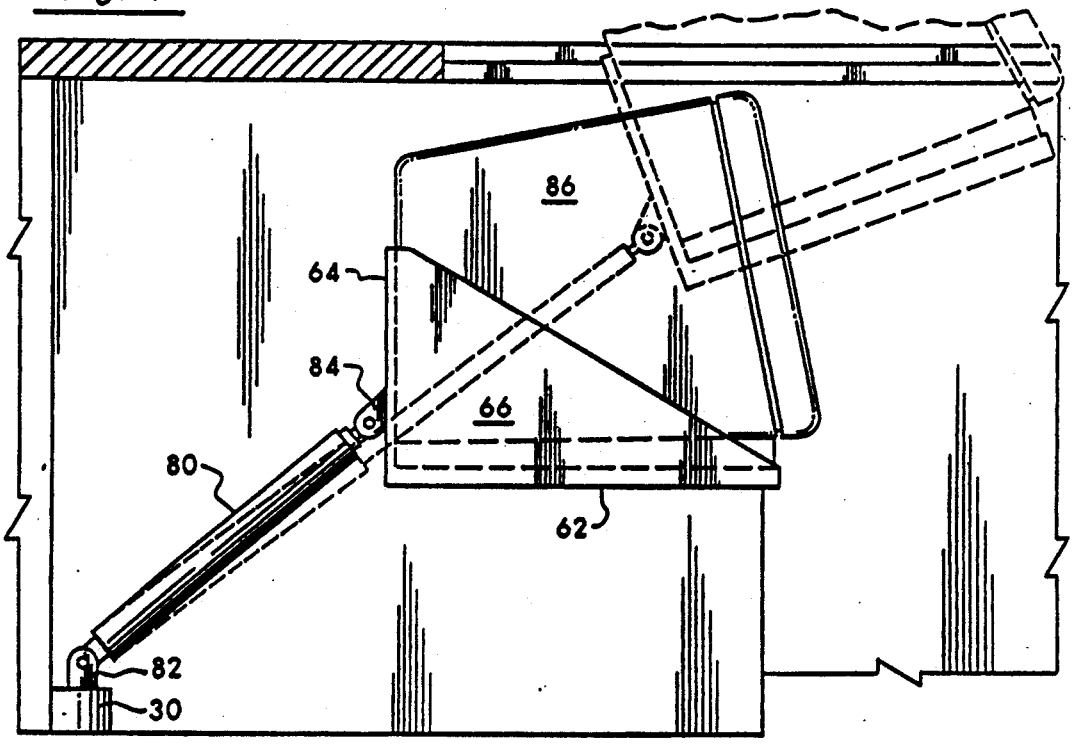
FIG. 4 is a side elevational view with parts added and removed of FIG. 3.

As illustrated in FIGS. 1 and 3, a pair of spaced apart support panels 20 and 22 are secured to the bottom surface 8 by suitable means, such as by welding if the top panel portion 4 and the support panels are formed from metal. A support shelf 24 is slidably mounted on tracks 26 and 28 fixedly mounted on the support panels 20 and 22. A keyboard (not shown) is supported on the slidable support shelf 24. A reinforcing bar 30 extends between the support panels 20 and 22 and is secured thereto by suitable means, such as by welding.

Figure 2:
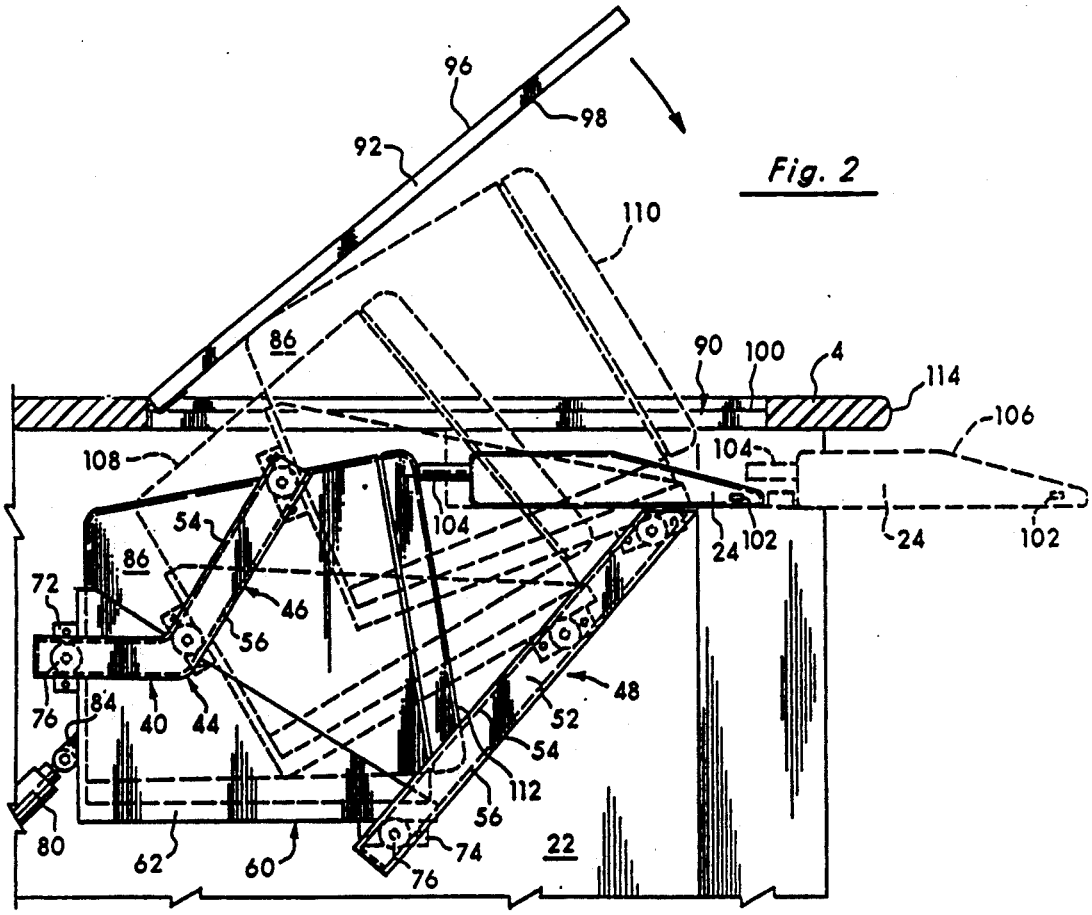
FIG. 2 is a schematic illustration of one preferred embodiment of the CRT monitor support means.

A first pair of facing guide means 40 and 42, FIGS. 2 and 3, are mounted on the support panels 20 and 22 by suitable means, such as by welding. Each of the guide means 40 and 42 has a first linear portion 44 lying generally in a horizontal plane and a second linear portion 46 extending upwardly therefrom and inclined relative thereto at an angle of about 60 degrees. A second pair of facing guide means 48 and 50 extend in a linear direction that is inclined relative to the horizontal at an angle of about 50 degrees. Each of the guide means 40, 42, 48 and 50 has a channel shape having a base 52 and integral sidewalls 54 and 56.

CRT monitor support means 60 are provided and comprise a rectangularly shaped bottom wall portion 62, a rectangularly shaped back wall portion 64 and two triangularly shaped sidewall portions 66 and 68. A ventilation opening 70 is formed in the back wall portion 64. Two spaced apart support brackets 72 are mounted on the back wall portion 64 and two spaced apart support brackets 74 are mounted on the bottom wall portion 62 by suitable means, such as by welding. A roller 76 is mounted for rotation on a shaft 78, FIG. 3, secured to each support brackets 72 and 74 for rolling movement over the guide means 40, 42, 48 and 50. A gas-spring 80, or any other force applying means is provided for moving the CRT monitor support means 60 over the guide means 40, 42, 48 and 50. The gas-spring 80 is pivotally mounted on the reinforcing bar 30 by pivot means 82 and on the back wall portion 64 by pivot means 84. It is understood that the gas-spring 80 can be mounted at any desired locations and although a gas-spring is the presently preferred power source, it is understood that other power sources can be used and which may require different mountings locations. A CRT monitor 86 is supported on the CRT monitor support means 60.

A rectangularly shaped opening 90 is formed in the top panel portion 4. A cover 92 having a rectangular shape similar to that of the opening 90 is pivotally mounted on the top panel portion 4 by pivot means 94 and has a top surface 96 and a bottom surface 98. A ledge 100 extends around the opening 90 and when the cover 92 is in the closed position, it is in contact with the ledge 100 so that the top surface 96 lies in the same plane as the top surface 6. Other means may be used to move the cover 92 such as connecting the cover 92 to the CRT monitor support means 60 for movement therewith.

The operation of the apparatus is illustrated in FIG. 2 wherein the support shelf 24, the CRT monitor 86 and the CRT monitor support means 60 are illustrated in the closed position by the solid lines. The support shelf 24 has locking means 102 for holding it in the closed position. Also, an integral projection 104 extends outwardly from the support shelf 24 and is in contact with the CRT monitor 86 to prevent movement thereof. Other types of apparatus can be used to retain the CRT monitor 86 in the closed position until it is desired to move it to the opened position. When it is desired to use the keyboard and the CRT monitor, the support shelf 24 is unlocked and pulled out to the position illustrated by the dashed line 106. The movement of the support shelf 24 permits the gas-spring 80 to apply a force on the CRT monitor support means 60 to move the rollers 76 over the guide means 40, 42, 48 and 50 to an intermediate position illustrated by the dashed lines 108. The movement of the CRT monitor support means 60 continues until it reaches its final position illustrated by the dashed line 110. As the CRT monitor 86 moves upwardly, it contacts the bottom surface 98 and pivots the cover 92 around the pivot means 94 so that the CRT monitor is visible to an operator. This mounting permits the front surface 112 to be spaced a distance from the front edge 114 of the top panel portion 4 to provide room for use of the desk when the CRT monitor is in the stored position and to be spaced a distance closer to the front edge 114 of the top panel portion 4 when in the operative position for easy viewing by the operator. Thus, when moving from the closed position to the opened position, the CRT monitor is moved upwardly and forwardly.

Figure 5:
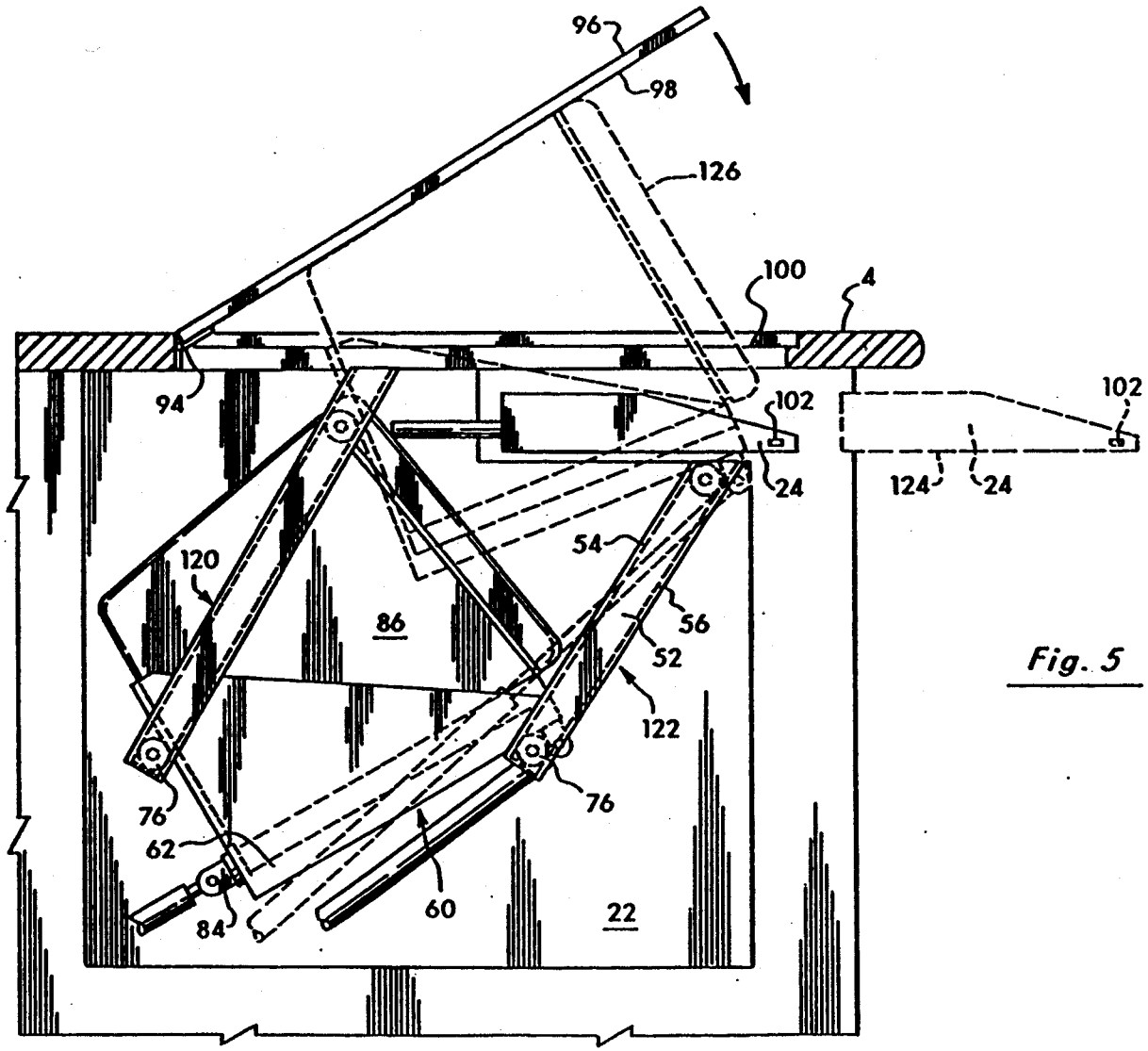
FIG. 5 is a schematic illustration of another preferred embodiment of the CRT monitor support means.

In FIG. 5, there is illustrated another preferred embodiment of the invention and wherein parts corresponding to those in FIGS. 1–4 have been given the same reference numerals. The only difference is in the first and second guide means. The first pair of facing guide means 120 are mounted on the support panels 20 and 22 and extend in a linear direction that is inclined relative to the horizontal at an angle of about 60 degrees. A second pair of facing guide means 122 are mounted on the support panels 20 and 22 and extend in a linear direction that is inclined relative to the horizontal at an angle of about 55 degrees.

The operation of the apparatus in FIG. 5 is similar to that in FIGS. 1–4. The support shelf 24, the CRT monitor 86 and the CRT monitor support means 60 are illustrated in the closed position by the solid lines. When the support shelf 24 has been moved to the opened position, illustrated by the dashed line 124, the CRT monitor 86 moves to the opened position, closer to the operator, illustrated by the dashed line 126.

Figure 6:
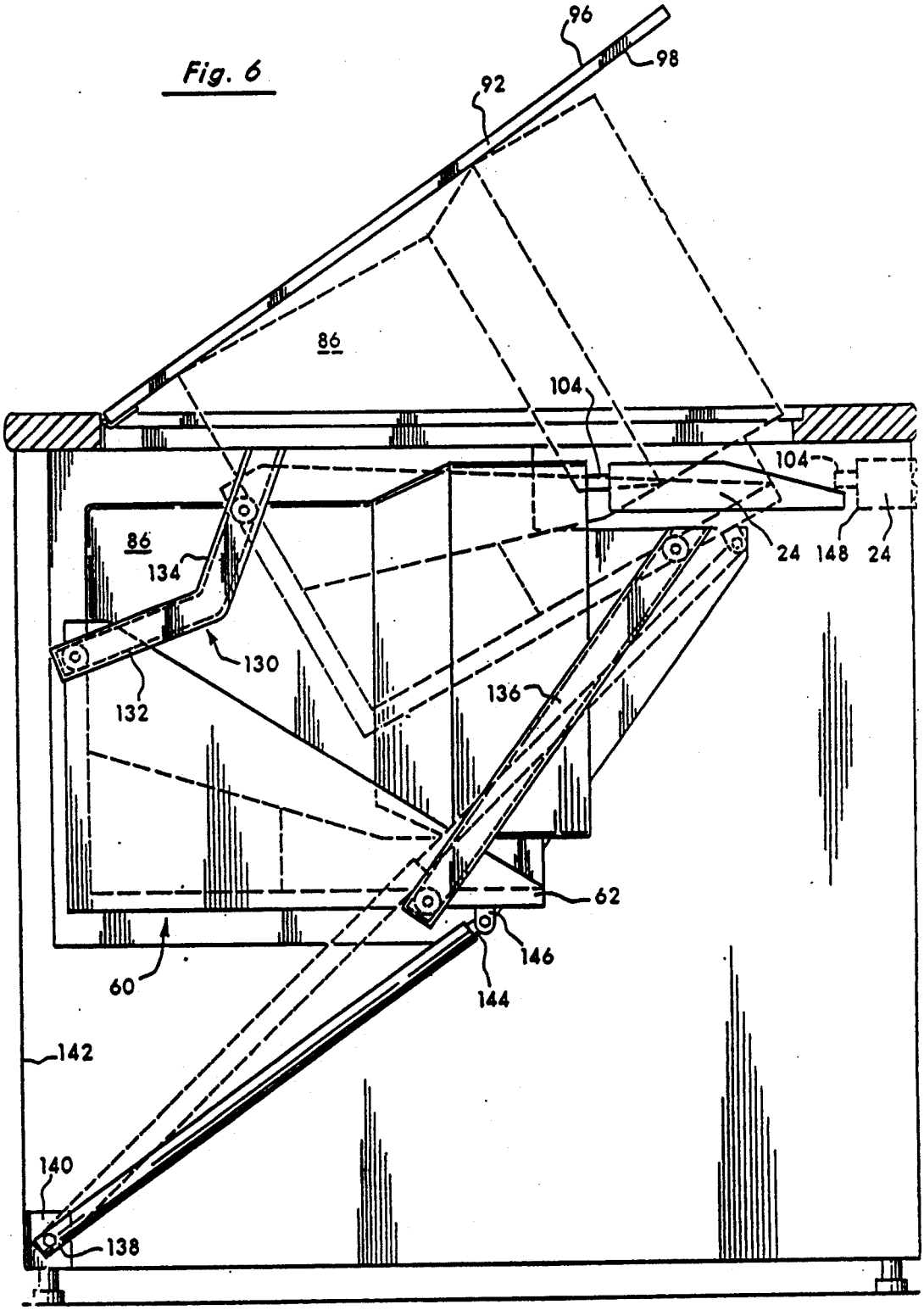
FIG. 6 is a schematic illustration of a further preferred embodiment of the CRT monitor support means.

In FIG. 6, there is illustrated a further preferred embodiment of the invention and wherein parts corresponding to those in FIG. 1 have been given the same reference numerals. The first difference in FIG. 6 is that the first and second guide means are shaped differently. The first pair of facing guide means 130 has a first linear portion 132 that is inclined slightly from the horizontal at an angle of about 20 degrees and a second linear portion 134 extending upwardly therefrom and inclined from the horizontal at an angle of about 70 degrees. The second pair of facing guide means 136 extend in a linear direction that is inclined relative to the horizontal at an angle of about 55 degrees.

The second difference in FIG. 6 is in the mounting of the gas spring 80. One end 138 of the gas spring 80 is pivotally mounted on a support 140 secured on the back wall 142 of the desk type work station 2. The other end 144 is pivotally mounted on a bracket 146 depending from one side of the bottom wall portion 62.

The operation of the apparatus of FIG. 6 is similar to that in FIGS. 1–4. The support shelf 24, the CRT monitor 86 and the CRT monitor support means 60 are illustrated in the closed position by the solid lines. When the support shelf 24 has been moved to the opened position, illustrated by the dashed line 148, the CRT monitor 86 moves to the opened position, closer to the operator, illustrated by the dashed line 150.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A desk type work station for holding and permitting operation of at least a CRT monitor comprising:

a top panel portion having a generally flat top work surface and an opposite bottom surface;

a pair of laterally spaced apart pedestal means for supporting said top panel portion;

an open space located beneath said top panel portion and between said laterally spaced apart pedestal means;

said top panel portion having an opening formed therein;

a movable cover portion for covering said opening and forming a portion of said generally flat top work surface;

shelf means for supporting a keyboard;

shelf support means for supporting said shelf means and permitting movement of said shelf means between closed and opened positions;

CRT monitor support means for supporting a CRT monitor; and mounting means for mounting said CRT monitor support means for movement between a first position at which said CRT monitor is located beneath said bottom surface and a second position at which at least a portion of said CRT monitor extends through said opening so that at least the screen of said CRT monitor is visible to an operator, wherein said mounting means include:

at least two spaced apart supports mounted at fixed locations;

first guide means having a first linear portion extending generally in a horizontal plane and a second linear portion extending upwardly therefrom and inclined relative thereto mounted on each of said spaced apart supports;

second guide means extending in a linear direction that is inclined to the horizontal and at an angle that differs from that of said second linear portion mounted on each of said spaced apart supports; and at least four guide followers mounted at spaced apart locations on said CRT support means for cooperating with said first and second guide means to guide said movement of said CRT support means.

2. The desk type work station of claim 1 wherein:

said movement of said CRT monitor support means is upward and forward.

3. The desk type work station of claim 1 wherein:

said cover portion having a generally flat top surface; and cover portion support means for supporting said cover portion so that its generally flat top surface and said generally flat top work surface of said top panel portion lie generally in the same plane.

4. The desk type work station of claim 3 and further comprising:

pivot means for pivotally mounting said cover portion on said top panel portion.

5. The desk type work station of claim 1 and further comprising:

retaining means movable between a first location at which said CRT support means is retained at its first position and a second location at which movement of said CRT support means from said first position to said second position is permitted.

6. The desk type work station of claim 5 and further comprising:

force applying means for applying a force on said CRT support means to move said CRT support means from said first position to said second position.

7. The desk type work station of claim 6 wherein:

said retaining means move with said shelf support means.

8. The desk type work station of claim 1 wherein:

said movement of said CRT monitor support means is upward and forward.

9. The desk type work station of claim 8 and further comprising:

retaining means movable between a first location at which said CRT support means is retained at its first position and a second location at which movement of said CRT support means from said first position to said second position is permitted.

10. The desk type work station of claim 9 and further comprising:

force applying means for applying a force on said CRT support means to move said CRT support means from said first position to said second position.

11. The desk type work station of claim 10 wherein:

said retaining means move with said shelf support means.

12. The desk type work station of claim 11 wherein:

said cover portion having a generally flat top surface; and cover portion support means for supporting said cover portion so that its generally flat top surface and said generally flat top work surface of said top panel portion lie generally in the same plane.

13. The desk type work station of claim 12 and further comprising:

pivot means for pivotally mounting said cover portion on said top panel portion.

14. The desk type work station of claim 12 wherein:

said first and second guide means each comprise a partially closed guide track; and each of said guide followers comprises a rotatable roller.

15. A desk type work station for holding and permitting operation of at least a CRT monitor comprising:

a top panel portion having a generally flat top work surface and an opposite bottom surface;

a pair of laterally spaced apart pedestal means for supporting said top panel portion;

an open space located beneath said top panel portion and between said laterally spaced apart pedestal means;

said top panel portion having an opening formed therein;

a movable cover portion having a generally flat top surface for covering said opening and forming a portion of said generally flat top work surface;

pivot means or pivotally mounting said cover portion on said top panel portion;

cover portion support means for supporting said cover portion so that its generally flat top surface and said generally flat top work surface of said top panel portion lie generally in the same plane;

shelf means for supporting a keyboard;

shelf support means for supporting said shelf means and permitting movement of said shelf means between closed and opened positions;

CRT monitor support means for supporting a CRT monitor;

mounting means for mounting said CRT monitor support means for movement upwardly and forwardly between a first position at which said CRT monitor is located beneath said bottom surface and a second position at which at least a portion of said CRT monitor extends through said opening so that at least the screen of said CRT monitor is visible to an operator, wherein said mounting means include:

at least two spaced apart supports mounted at fixed locations;

first guide means and second guide means having partially closed guide tracks mounted on each of said spaced apart supports; wherein each of said first guide means comprising a first linear portion extending at an angle inclined from the horizontal and a second linear portion extending upwardly therefrom at a greater angle inclined from the horizontal; and each of said second guide means extending in a linear direction at an angle inclined from the horizontal that differs from that of said first and second linear portions;

at least four guide followers having rotatable rollers mounted at spaced apart locations on said CRT support means for cooperating with said first and second guide means to guide said movement of said CRT support means;

retaining means movable with said shelf support means between a first location at which said CRT support means are retained at said first position and a second location at which movement of said CRT support means from said first position to said second position is permitted; and force applying means for applying a force on said CRT support means to move said CRT support means from said first position to said second position.

16. A desk type work station for holding and permitting operation of at least a CRT monitor comprising:

a top panel portion having a generally flat top work surface and an opposite bottom surface;

a pair of laterally spaced apart pedestal means for supporting said top panel portion;

an open space located beneath said top panel portion and between said laterally spaced apart pedestal means;

said top panel portion having an opening formed therein;

a movable cover portion for covering said opening and forming a portion of said generally flat top work surface;

shelf means for supporting a keyboard;

shelf support means for supporting said shelf means and permitting movement of said shelf means between closed and opened positions;

CRT monitor support means for supporting a CRT monitor;

and mounting means for mounting said CRT monitor support means for movement between a first position at which said CRT monitor is located beneath said bottom surface and a second position at which at least a portion of said CRT monitor extends through said opening so that at least the screen of said CRT monitor is visible to an operator, wherein said mounting means include:

at least two spaced apart supports mounted at fixed locations;

first guide means having a partially closed guide track and extending in a linear direction that is inclined to the horizontal mounted on each of said spaced apart supports;

second guide means having a partially closed guide track and extending in a linear direction that is inclined to the horizontal and at an angle that differs from that of said first guide means mounted on each of said spaced apart supports; and at least four guide followers having a rotatable roller mounted at spaced apart locations on said CRT support means for cooperating with said first and second guide means to guide said movement of said CRT support means.

17. A desk type work station for holding and permitting operation of at least a CRT monitor comprising:

a top panel portion having a generally flat top work surface and an opposite bottom surface;

a pair of laterally spaced apart pedestal means for supporting said top panel portion;

an open space located beneath said top panel portion and between said laterally spaced apart pedestal means;

said top panel portion having an opening formed therein;

a movable cover portion for covering said opening and forming a portion of said generally flat top work surface;

shelf means for supporting a keyboard;

shelf support means for supporting said shelf means and permitting movement of said shelf means between closed and opened positions;

CRT monitor support means for supporting a CRT monitor;

and mounting means for mounting said CRT monitor support means for movement between a first position at which said CRT monitor is located beneath said bottom surface and a second position at which at least a portion of said CRT monitor extends through said opening so that at least the screen of said CRT monitor is visible to an operator, wherein said mounting means include:

at least two spaced apart supports mounted at fixed locations;

first guide means having a first linear portion extending at an angle inclined from the horizontal and a second linear portion extending upwardly therefrom and inclined at a greater angle from the horizontal mounted on each of said spaced apart supports;

second guide means extending in a linear direction at an angle inclined from the horizontal that differs from that of said first and second linear portions mounted on each of said spaced apart supports; and at least four guide followers mounted at spaced apart locations on said CRT support means for cooperating with said first and second guide means to guide said movement of said CRT support means.

* * * * *